US009643132B2

(12) United States Patent
Shah et al.

(10) Patent No.: US 9,643,132 B2
(45) Date of Patent: May 9, 2017

(54) APPARATUS AND METHOD FOR MIXING OF CORROSIVE AND NON-CORROSIVE GAS

(75) Inventors: Louise Jivan Shah, Vedbæk (DK); Per Morsing, Vedbæk (DK); Søren Heinesen, Copenhagen V (DK)

(73) Assignee: Haldor Topsoe A/S, Lyngby (DK)

( * ) Notice: Subject to any disclaimer, the term of this patent is extended or adjusted under 35 U.S.C. 154(b) by 1256 days.

(21) Appl. No.: 13/579,960

(22) PCT Filed: Feb. 22, 2010

(86) PCT No.: PCT/EP2010/052201

§ 371 (c)(1),
(2), (4) Date: Aug. 20, 2012

(87) PCT Pub. No.: WO2011/101038

PCT Pub. Date: Aug. 25, 2011

(65) Prior Publication Data

US 2012/0314526 A1 Dec. 13, 2012

(51) Int. Cl.

| | |
|---|---|
| ***B01F 3/00*** | (2006.01) |
| ***B01F 3/02*** | (2006.01) |
| ***B01F 5/04*** | (2006.01) |
| *B01F 5/00* | (2006.01) |

(52) U.S. Cl.

CPC ..... *B01F 3/02* (2013.01); *B01F 5/046* (2013.01); *B01F 5/0451* (2013.01); *B01F 5/0453* (2013.01); *B01F 2005/0017* (2013.01)

(58) Field of Classification Search

CPC . B01F 3/02; B01F 3/04503; B01F 2005/0017
See application file for complete search history.

(56) References Cited

U.S. PATENT DOCUMENTS

| | | | | |
|---|---|---|---|---|
| 2004/0156763 | A1* | 8/2004 | Wood | B01F 5/0453 422/600 |
| 2005/0095185 | A1* | 5/2005 | Gary | B01F 3/02 422/224 |

FOREIGN PATENT DOCUMENTS

| | | | |
|---|---|---|---|
| EP | 1 770 253 | A1 | 4/2007 |
| EP | 1 930 645 | A1 | 6/2008 |
| GB | 1141888 | A | 2/1969 |
| JP | 9-14536 | A | 1/1997 |
| JP | 2005-016686 | A | 1/2005 |
| RU | 1813532 | A1 | 5/1993 |
| RU | 2 136 355 | C1 | 9/1999 |
| SU | 611655 | A1 | 6/1978 |
| WO | WO 2009/078899 | A1 | 6/2009 |

* cited by examiner

*Primary Examiner* — Tony G Soohoo
*Assistant Examiner* — Anshu Bhatia
(74) *Attorney, Agent, or Firm* — Blank Rome LLP

(57) ABSTRACT

Present application relates to a mixing device (10) for mixing a first gas with a second gas, the second gas being corrosive to the mixing device. The mixing device comprises a first gas guiding part (12) having a first gas guiding inlet part (14) and a first gas guiding outlet part (16), a second gas guiding part (18) having a second gas guiding inlet part (20) and a second gas guiding outlet part (22), the second gas guiding outlet part arranged in the first gas guiding part so that the first gas and the second gas are mixed and a guide vane configured to establish a swirling motion in the first gas. Further disclosed is a related method.

3 Claims, 2 Drawing Sheets

APPARATUS AND METHOD FOR MIXING OF CORROSIVE AND NON-CORROSIVE GAS

Figure 1:
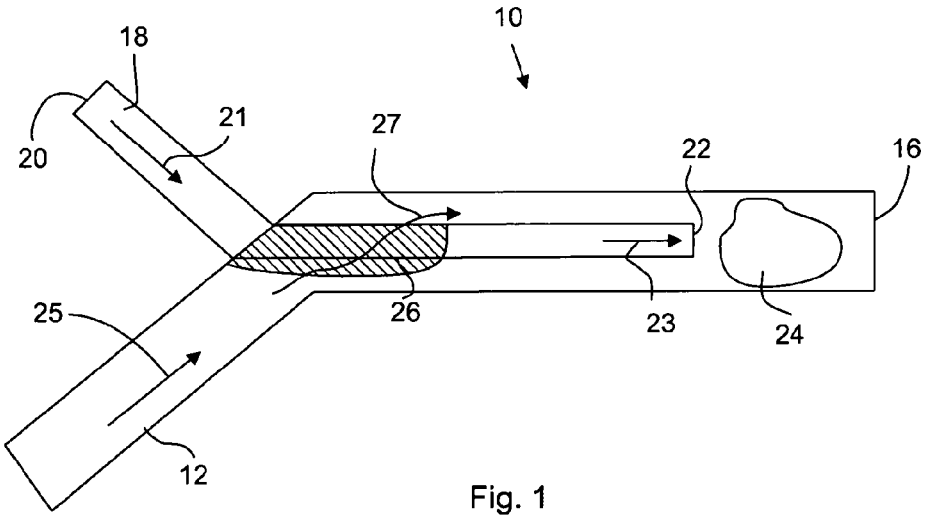

The present invention relates to a mixing device. The present invention further relates to a method for mixing. In particular, the present invention relates to a mixing device for mixing two or more gases. The mixing device may be part of a large apparatus, such as a production apparatus.

When mixing gases that wherein at least one gas is corrosive to the mixing device, there is a need for protecting the mixing device. This may be achieved by applying lining or coating to the interior of the mixing device. Lining and coating may be expensive and will eventually wear off. The present invention provides a device that overcomes at least these problems.

In a first aspect, the present invention relates to a mixing device for mixing a first gas with a second gas, the second gas being corrosive to the mixing device, the mixing device comprising a first gas guiding part having a first gas guiding inlet part end and a first gas guiding outlet part end, a second gas guiding part having a second gas guiding inlet part and a second gas guiding outlet part, the second gas guiding outlet part arranged in the first gas guiding part so that the first gas and the second gas are mixed, and a guide vane configured to establish a swirling motion in the first gas.

The arrangement of the mixing device is contemplated to allow the gases to mix and the temperature of the second gas to increase so that the inner surface of the outer, first gas guiding part is not corroded by the second gas. This is advantageous as this reduces the need for lining and coatings on the inner surface of the first gas guiding part.

Advantageously, a mixing zone is formed in the first gas guiding part, and the guide vane is arranged in the first gas guiding part in the flow of the first gas upstream of the mixing zone. The swirling motion may improve the mixing of the two gases.

In an embodiment, the second gas guiding inlet part is arranged outside the first gas guiding part.

In an embodiment, the first gas is a hot, relatively dry gas and the second gas is a, relatively, wet, corrosive gas. The second gas is corrosive to the first gas guiding part at a given, high, temperature. After the two gases have been mixed in the mixing device, the resultant mixed gas has a temperature above the acid dew point and thus no corrosive fluids are formed on the inside of the first gas guiding part.

In an embodiment, the second gas guiding outlet part is arranged so that the first gas forms a protection zone, where the second gas is prevented from coming into contact with the first gas guiding part. The protection zone may be an area or volume around the flow of the second gas.

In an embodiment, the second gas guiding part includes two gas guiding parts arranged coaxially as an inner and an outer gas guiding part, the gas guiding parts arranged so that when discharging respective gas from the respective gas guiding parts, the outer gas guiding part provides a gas layer between the first gas and the second gas. This is further advantageous as an inner gas guiding part may be protected by an intermediate gas from an outer corrosive gas.

In an embodiment, the temperature of the first gas is higher at the beginning of the mixing zone than the temperature of the second gas at the beginning of the mixing zone.

A second aspect of the present invention relates to a method for mixing a first gas and a second gas, the method comprising the steps of providing a mixing device for mixing the first gas with the second gas, the second gas being corrosive to the mixing device, the mixing device comprising: a first gas guiding part having a first gas guiding inlet part end and a first gas guiding outlet part end, a second gas guiding part having a second gas guiding inlet part and a second gas guiding outlet part, the second gas guiding outlet part arranged in the first gas guiding part so that the first gas and the second gas are mixed, providing a first flow comprising the first gas at the first gas guiding inlet, providing a second flow comprising the second gas at the second gas guiding inlet, and a mixing zone being defined in the first gas guiding part, the first flow surrounding the second flow so that the first flow in the mixing zone is near the first gas guiding part.

Advantageously, the first flow hinders the second flow from contacting the inner surface of the first gas guiding part thus reducing or eliminating corrosion of the inner surface. When the two gases have been mixed, the temperature of the mixture has increased to a temperature above the acid dew point.

In an embodiment, the first gas is a hot, relatively dry gas and the second gas is a wet, corrosive gas. The second gas may be corrosive only to the outer, first gas guiding part. The first gas is not necessarily completely dry in the sense that it does not comprise any vapours, such as water vapour. The first gas may comprise sulphuric acid vapour.

In an embodiment the first gas may be atmospheric air. In the embodiment where the first gas is or comprises atmospheric air the water content of the first gas may depend on the water content of the surrounding air. The actual water content may be determined before supplying the atmospheric air to the mixing device. The first gas may be heated before being supplied to the mixing device or may be heated in the mixing device.

In an embodiment the first gas comprises water vapour and sulphuric acid vapour.

In an embodiment, the first gas and the second gas in a mixing zone flow in substantially parallel directions. Advantageously, the two flows are arranged so that the gases are mixed before the second gas comes into contact with the inner surface of the first gas guiding part.

In an embodiment, the method further comprises establishing a swirling motion in the first gas, before the first gas and the second gas are mixed.

In an embodiment of the method, the first gas has a temperature at the beginning of the mixing zone in the range from 150 degrees Celsius to 400 degrees Celsius and/or the second gas has a temperature in the range from 0 degrees Celsius to 250 degrees Celsius. Generally, the first gas has a higher temperature than the second gas to provide a temperature increase of the second gas after mixing.

A third aspect of the present invention relates to an apparatus for mixing a first gas with a second gas, the first gas being corrosive to part of the mixing device, the mixing device comprising a first gas guiding part having a first gas guiding inlet part end and a first gas guiding outlet part end, a second gas guiding part having a second gas guiding inlet part and a second gas guiding outlet part, the second gas guiding outlet part arranged in the first gas guiding part, a third gas guiding part having a third gas guiding inlet part and a third gas guiding outlet part, the third gas guiding outlet part arranged substantially around the second gas guiding part, the mixing device configured to receive a first gas, a second gas and a third gas at the first gas guiding inlet part, the second gas guiding inlet part and the third gas guiding inlet part, respectively, the first gas guiding outlet part, the second gas guiding outlet part and the third gas guiding outlet part arranged so that the first gas, the second gas and the third gas are all mixed.

In an embodiment, the third gas is provided so that the first gas is prevented from coming into contact with the surface of the second gas guiding part.

Preferably, at the beginning of the mixing zone, just before the mixing begins, the temperature of the second gas is below the dew point of the first gas. Further the temperature of the third gas, i.e. the protective gas is preferably above the dew point of the first gas.

In an embodiment, the apparatus may further comprise a guide vane configured to establish a swirling motion in the first gas.

The features and advantages mentioned in relation to the first, second and third aspect may apply equally to the other aspects of the present invention.

Figure 2:
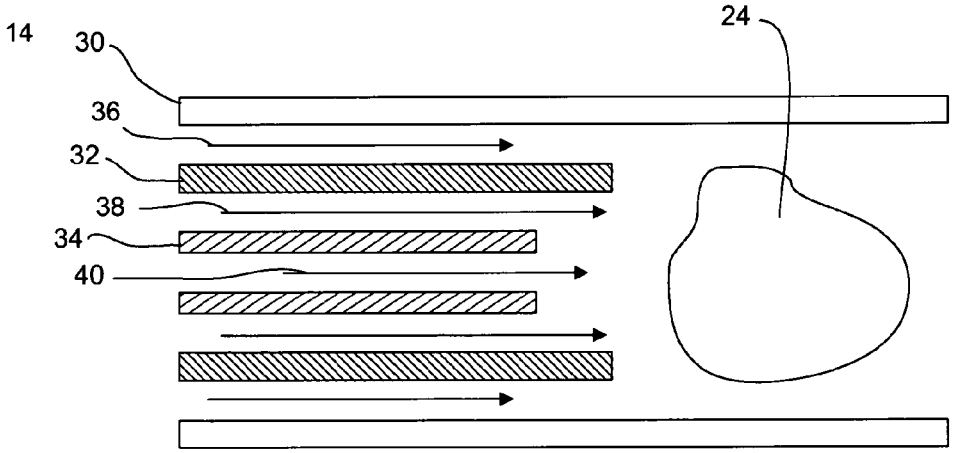
Figure 6:
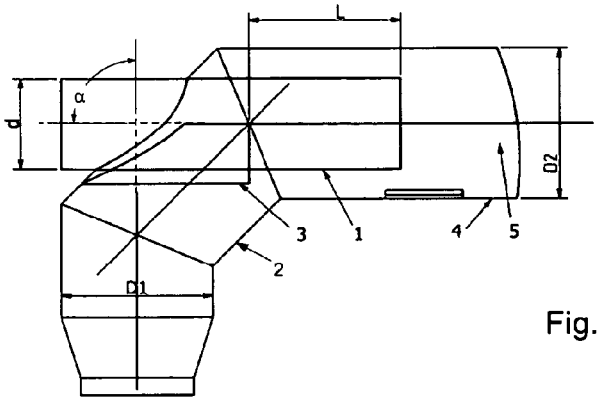
Figure 3:
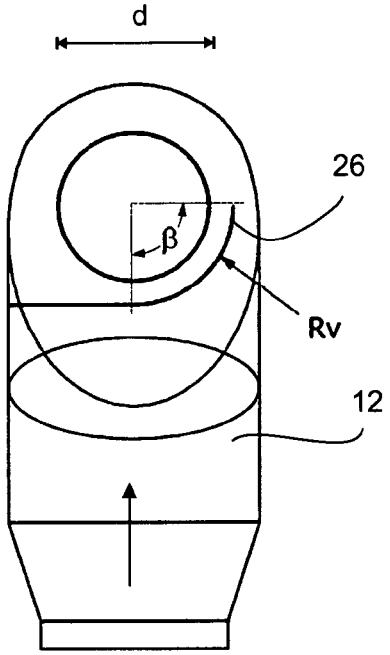
Figure 5:
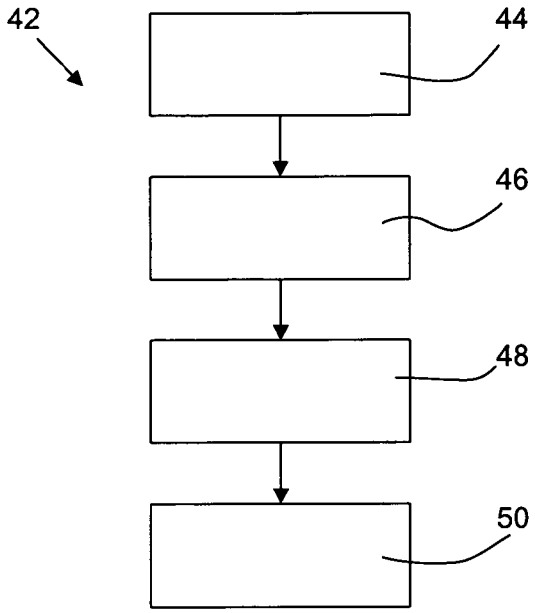
Figure 4:
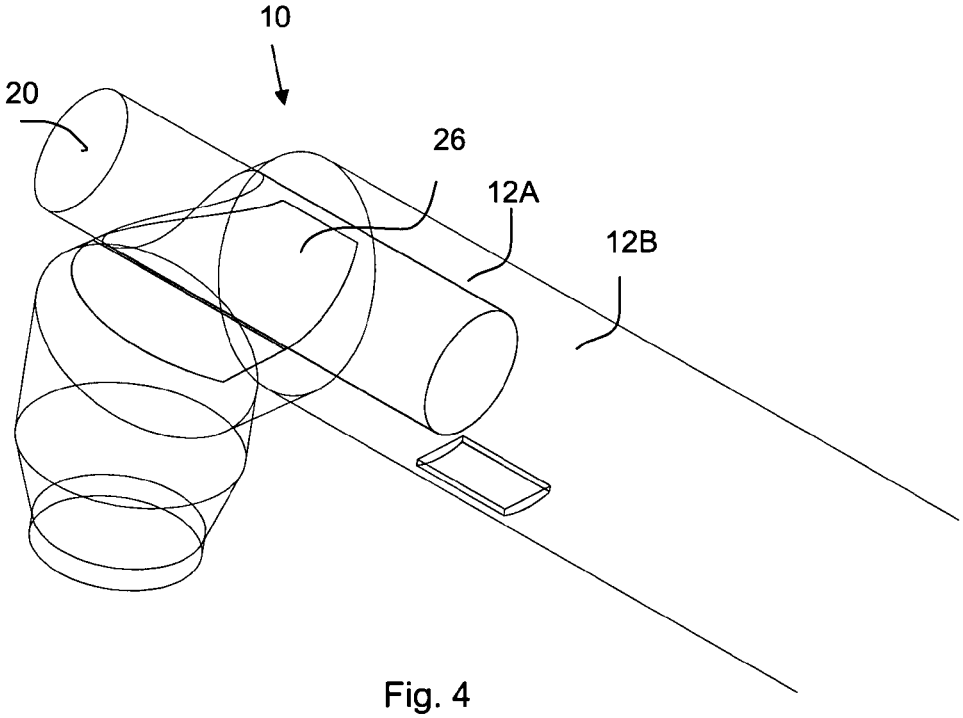

The present invention will be discussed in more detail with reference to the embodiments in the drawings in which:

FIG. 1 is a schematic view of a part of a first embodiment of a mixing device, FIG. 2 is a schematic view of a part of a second embodiment of a mixing device, FIG. 3 is a schematic front view of the first embodiment of the mixing device, FIG. 4 is a schematic perspective view of a first embodiment of the mixing device, FIG. 5 is a schematic flow-diagram illustrating steps of a method for mixing two gases, and FIG. 6 is a schematic view of the second embodiment of the mixing device.

FIG. 1 illustrates a mixing device 10 schematically. The mixing device 10 is configured for mixing a first gas with a second gas. In the presently preferred embodiment, the device is used for mixing two gases, where one gas is corrosive to the mixing device.

The mixing device 10 comprises a first gas guiding part 12 having a first gas guiding part inlet 14 and a first gas guiding part outlet 16. The mixing device 10 further comprises a second gas guiding part 18 having a second gas guiding part inlet 20 and a second gas guiding part outlet 22. The second gas guiding part outlet 22 is arranged in the first gas guiding part 12 so that the first gas and the second gas are mixed. A mixing zone is defined in the first gas guiding part 12. The mixing zone extends substantially from the area at the second gas guiding part outlet 22. The size of the mixing zone 24 depends on the flow volume and speed of the gases and may also depend on the viscosity and temperature of the gases.

When using a mixing device according to the present invention, one advantage is that the inner surface in the mixing pipe may be kept dry and above the acid dew point temperature during the mixing process. Thus, corrosion of the inner pipe may be avoided without the use of an expensive corrosion resistant inner liner made of e.g. PFA/PTFE.

Generally, it is preferred that the temperature of the first gas is higher at the beginning of the mixing zone than the temperature of the second gas at the beginning of the mixing zone. The dynamics of the gases will ensure that the two gases are mixed. The temperature of the mixture will depend on the mass flows of the gases, the starting temperatures of the gases and the heat capacity of the gases. The mixing device may be used for mixing two, three or more gases.

As it may be seen in FIG. 1, the inner pipe 18 is inserted in a bend of the outer pipe 12 and introduces wet, corrosive gas, as indicated by the arrows 21 and 23, in parallel flow with the hot, relatively dry gas, as indicated by the arrows 25 and 27, at the beginning of the mixing zone 24, which starts at the outlet 22 of the inner pipe 18. In the presently preferred embodiment of the present invention, the gas guiding parts 12 and 18 are formed as pipes with circular cross section, but other geometries may be used, such as elliptical, oval, square, rectangular or any polygonal form or combinations thereof.

The mixing device 10 further comprises a guide vane 26 configured to establish a swirling motion in the first gas. The swirling motion may be laminar. Alternatively, the swirling motion may be turbulent. There may be small areas in the laminar flow where turbulence is present, but the turbulence may be negligible.

The guide vane 26 provides a swirling motion to the hot, relatively dry gas, as indicated by the arrow 27, allowing the gas to swirl around the inner pipe 18. The swirling motion continues into the mixing zone 24 where it facilitates mixing of the gases and keeps the internal surface of the mixing device 10 dry and ensures a wall temperature of the mixing device above the acid dew point. Owing to the guide vane 26, corrosion of the mixing device 10 may be avoided in the mixing zone 24 without the use of an expensive corrosive resistant liner to protect the mixing device. The mixing device 10 may be produced in carbon steel or stainless steel or any other suitable material.

The inclusion of the guide vane 26 further allows operation at a lower hot, relatively dry gas-to-wet gas molar ratio than when using an embodiment without the guide vane 26.

In the preferred embodiment of the invention, the inner pipe 18 is inserted in a mitre bend of the outer pipe 12 parallel to the centre line of the mixing pipe. The mitre bend includes a 45° section. The extension of the inner pipe from the intersection of the centre lines of the 45° section of the mitre bend and the gas guiding part 12A equals 0.1-3 times and preferably 0.3-2 times the diameter of the gas guiding part 12A. More preferably, the length of the gas guiding part 18 that is not covered by the guide vane 26 equals the diameter of gas guiding part 12A.

The angle ($\alpha$) between the inlet gas direction and the mixing pipe centre line is in the range 50-170°, preferably 70-130°, more preferably around 90°.

The radius of curvature of the guide vane (Rv), see FIG. 3, may be between ½ d, the diameter of the inner gas guiding part, and (1/12d+5/12D1), where D1 is the diameter of first gas guiding part at the inlet section, preferably the radius of curvature of the guide vane equal to (D1+d)/4.

The diameter of the mixing pipe (D2) equals 0.6-2 times, preferably 0.8-1.5 times the diameter of the hot dry gas pipe (D1). More preferably, the two diameters are substantially equal.

The angle ($\beta$) of the guide vane is in the range 0-360°, preferably 45-180°.

In the preferred design of the invention, the ratio of the average axial velocity of the hot relatively dry gas in the annulus between the outer and inner pipe at the outlet of the inner pipe, and the average axial velocity in the inner pipe is 0.4 to 2.5 preferably 0.6 to 1.7.

Preferably, the gas guiding parts have a circular cross section. The cross section of the first and/or the second gas guiding part may be circular, oval, elliptical, square, rectangular, pentagonal, hexagonal, or may define any polygonal geometry or combinations thereof.

The guide vane 26 is located upstream of the mixing zone 24, i.e. in the first gas guiding part 12 in an area before the mixing zone, when the first and second gases flow in the direction of the arrow 23.

In the embodiment illustrated in FIG. 1, the second gas guiding part inlet 20 is arranged outside the first gas guiding part 12. This establishes two inlets and thus allows two gases to be supplied to the mixing device.

In a presently preferred embodiment, the first gas is a hot, relatively dry gas and the second gas is a wet, corrosive gas. The wet, corrosive gas should be prevented from coming into contact with the inside of the first gas guiding part 12. This is achieved by the arrangement of the two gas guiding parts. Further, the guide vane 26 ensures that desirable mixing conditions are achieved. The size and precise location of the guide vane 26 may be chosen so as to optimise movement in the gases at the mixing zone thus decreasing the required area of the mixing zone, i.e. the two gases are mixed quickly.

Preferably in this setup, the second gas guiding outlet part is arranged so that the first gas forms a protection zone, where the second gas is prevented from coming into contact with the first gas guiding part. This is contemplated to prolong the effective operation time of the mixing device. It may also provide a better yield as the second gas does not loose active ingredients by the chemical reaction with the material in the first gas guiding part.

FIG. 2 illustrates an embodiment schematically, where the second gas guiding part includes two gas guiding parts, 34 and 32, arranged coaxially as an inner and an outer gas guiding part, respectively. The gas guiding parts are arranged so that when discharging respective gas from the respective gas guiding parts, the outer gas guiding part 32 provides a third gas layer 38 between the first gas and the second gas.

The embodiment in FIG. 2 may also be advantageous when a gas being corrosive to the inner, second gas guiding part is to be mixed with another gas. A middle or intervening layer is introduced so that the outermost gas, which is corrosive to the innermost gas guiding part, does not come into contact with the innermost gas guiding part. The first gas flow or layer 36 is thus corrosive to the gas guiding part 34. The second gas flow or layer 40 is to be mixed with the first gas flow or layer 36 and the third gas flow or layer 38 in the mixing zone 24.

The following lists three examples relating to gas in an embodiment of the mixing device according to the present invention:

The dimensions of the mixing device in the below examples are: diameter of inlet pipe or first gas guiding part before mixing zone (D1): 2000 mm, diameter of first gas guiding part at mixing zone (D2): 2000 mm, diameter of second gas guiding part (d): 1200 mm, length of second gas guiding part inside the first gas guiding part (L): 2000 mm. See FIG. 6 for the reference numerals.

Hot, relatively dry gas: Flow: 34804 kg/h, Mole weight: 29, Temperature: 219° C., Pressure 1005 mbar, heat capacity: 0.256 kcal/kg/° C.

Wet, corrosive gas: Flow: 33051 kg/h, Mole weight: 29, Temperature: 100° C., Pressure 1000 mbar, heat capacity: 0.265 kcal/kg/° C., sulphuric acid mist content 30 ppm by volume, acid dew point: 152° C.

Fully mixed gas: Flow: 67855 kg/h, Mole weight: 29, Temperature: 160° C., Pressure 1000 mbar, sulphuric acid mist content 15 ppm by volume, acid dew point: 138° C.

The inner surface temperature of the mixing duct was calculated by use of computational fluid dynamics. The calculated minimum inner surface temperature of mixing pipe is (excluding heat loss to surroundings and heat conduction in pipe wall): 150° C.

The minimum temperature of the inner surface of the mixing pipe is above the acid dew point of the mixed gas with a good margin, and the mixing pipe will not corrode.

A calculation was done with the same gas conditions as in the above example but without a guide vane.

The inner surface temperature of the mixing duct was calculated by use of computational fluid dynamics. The calculated minimum inner surface temperature of mixing pipe is (excluding heat loss to surroundings and heat conduction in pipe wall): 135° C.

The minimum temperature of the inner surface of the mixing pipe is below the acid dew point of the mixed gas and the mixing pipe will corrode.

In an embodiment where the mixing device does not include a guide vane, and the inner pipe is short, a calculation was performed using the same gas conditions as in the example above.

The inner surface temperature of the mixing duct was calculated by use of computational fluid dynamics. The calculated minimum inner surface temperature of mixing pipe is (excluding heat loss to surroundings and heat conduction in pipe wall): 132° C.

The minimum temperature of the inner surface of the mixing pipe is below the acid dew point of the outlet gas and thus the mixing pipe will corrode.

The above examples substantiate the effect of the guide vane.

FIG. 3 illustrates the mixing device 10 of FIG. 1 in a different view. The guide vane 26 is attached to the inner surface of the gas guiding part 12. The guide vane 26 forces the first gas to flow around the guide vane 26 as illustrated in FIG. 1 by the arrow 27.

FIG. 4 is a schematic perspective view of the mixing device 10. As indicated in FIG. 4 the gas guiding part 12 may be divided in two parts, the part before the outlet of the inner pipe 26, namely the part 12A, and the part after the outlet of the inner pipe 26, namely the part 12B. The parts 12A and 12B are not required to have similar diameters. The part 12B may have a larger diameter than the part 12A. Thereby a larger mixing zone may be established.

As also mentioned elsewhere in a further embodiment the gas guiding part 12B may have a diameter being smaller than the diameter of the gas guiding part 12A. In a presently preferred embodiment the two parts 12A and 12B have similar or identical diameters.

Furthermore, the gas guiding part 12 may include bends or twists, not illustrated here. For instance the gas guiding part may include or be connected to a 90 degree bend to connect to a chimney or exhaust or outlet.

FIG. 5 is a schematic flow-diagrammatic view of steps 42 in a method for mixing a first gas and a second gas. The method comprises the steps 42 of providing 44 a mixing device for mixing the first gas with the second gas, the second gas being corrosive to the mixing device, the mixing device comprising a first gas guiding part having a first gas guiding inlet part end and a first gas guiding outlet part end, a second gas guiding part having a second gas guiding inlet part and a second gas guiding outlet part, the second gas guiding outlet part arranged in the first gas guiding part so that the first gas and the second gas are mixed. The method further comprises the step 46 of providing a first flow comprising the first gas at the first gas guiding inlet. The method further comprises the step 48 of providing a second flow comprising the second gas at the second gas guiding inlet. A mixing zone is defined in the first gas guiding part, the first flow surrounding the second flow so that the first flow in the mixing zone is near the first gas guiding part.

The method may be performed using a mixing device as described in relation to any of the FIGS. 1-4 and 6.

FIG. 6 is a schematic view of an embodiment of the mixing device. The mixing device includes a mitre bend with an angle of 45 degrees as described above.

The invention claimed is:

1. A mixing device for mixing a first gas with a second gas, the second gas being corrosive to at least part of the mixing device, the mixing device comprising:

a first gas guiding part having an axis, a first gas guiding inlet part end arranged transverse to said axis and a first gas guiding outlet part end arranged along said axis so that said first gas is introduced into said first guiding part, a second gas guiding part having a second gas guiding inlet part and a second gas guiding outlet part, the second gas guiding outlet part arranged within the first gas guiding part and terminating upstream of said first gas guiding outlet part to define a downstream mixing zone so that the first gas and the second gas are mixed in a mixing zone within said first gas guiding part, and a guide vane proximal to said first inlet part end and upstream of said second gas guiding outlet part end, said vane arranged and configured so that said first gas impinges said vane and is redirected to establish a swirling motion in the first gas upstream of said mixing zone; said guiding vane cooperating with said first and second gas guiding outlet parts to form a protection zone from said first, gas for said first gas guiding part in said mixing zone.

2. The mixing device according to claim 1, wherein the second gas guiding inlet part is arranged outside the first gas guiding part.

3. The mixing device according to claim 1, wherein the second gas guiding part includes two gas guiding parts arranged coaxially as an inner and an outer gas guiding part, the inner and an outer gas guiding parts arranged so that when discharging respective gas from the respective inner and an outer gas guiding parts, the outer gas guiding part provides a gas layer between the first gas and the second gas.

* * * * *